United States Patent [19]

Houston

[11] Patent Number: 4,919,419

[45] Date of Patent: Apr. 24, 1990

[54] EXERCISE APPARATUS

[75] Inventor: Stepher R. Houston, Gaithersburg, Md.

[73] Assignee: Magnaflex Associates Limited, Gaithersburg, Md.

[21] Appl. No.: 270,449

[22] Filed: Nov. 7, 1988

Related U.S. Application Data

[63] Continuation of Ser. No. 130,604, Dec. 9, 1987, abandoned, which is a continuation-in-part of Ser. No. 88,425, Aug. 24, 1987, abandoned.

[51] Int. Cl.[5] ..... A63B 21/00

[52] U.S. Cl. ..... 272/134; 272/144

[58] Field of Search ..... 272/123, 144, 117, 118, 272/134

[56] References Cited

U.S. PATENT DOCUMENTS

| | | | |
|---|---|---|---|
| 3,118,668 | 1/1964 | Callahan | 272/123 |
| 3,814,414 | 6/1974 | Chapa | 269/323 |
| 3,948,513 | 4/1976 | Pfotenhauer | 272/144 |
| 4,072,309 | 2/1978 | Wilson | 272/144 |
| 4,286,782 | 9/1981 | Fuhrhop | 272/117 |
| 4,368,884 | 1/1983 | Colvin | 272/123 |
| 4,549,733 | 10/1985 | Salyer | 272/118 |
| 4,564,194 | 1/1986 | Dawson | 272/123 |
| 4,635,930 | 1/1987 | Cormier | 272/123 |
| 4,635,934 | 1/1987 | Roethke | 272/144 |
| 4,655,448 | 4/1987 | Harder | 272/144 |
| 4,705,267 | 11/1987 | Jackson | 272/123 |
| 4,826,157 | 5/1989 | Fitzpatrick | 272/144 X |

*Primary Examiner*—V. Millin
*Assistant Examiner*—H. Flaxman
*Attorney, Agent, or Firm*—Joseph P. Nigon

[57] ABSTRACT

An exercise device in which the bench board member is mounted on a tubular bench pad beam having a sliding adjuster positioned therein. The bench board member is adjustable to four separate positions by manipulation of the bench pad beam.

1 Claim, 4 Drawing Sheets

EXERCISE APPARATUS

This application is a continuation of application Ser. No. 130,604, filed Dec. 9, 1987, abandoned, which is a continuation in part of application Ser. No. 88,425, filed Aug. 24, 1987, now abandoned.

BACKGROUND OF THE INVENTION

The present invention relates generally to body exercise devices. More particularly the invention concerns a bench type exercising apparatus for use in the performance of arm and leg exercises having movable, multi-positionable body engaging elements which are operably associated with weights disposed at the proximate end of the bench. An arrangement interconnects the body engaging elements with one or more of the weights.

DESCRIPTION OF THE PRIOR ART

There are several patents disclosing exercising devices and equipment. U.S. Pat. No. 4,369,966 relates to a folding exercise apparatus for developing and conditioning various parts of the body. U.S. Pat. Nos. 4,007,495 and 4,286,782 disclose multi-purpose exercising devices. U.S. Pat. No. 3,707,285 discloses a horizontal bar exercising device. U.S. Pat. No. 2,038,899 discloses a scaffold machine in which a wedging action is used to limit bracket movement. U.S. Pat. Nos. 2,876,321 and 1,591,781 disclose clamp and pin structures and U.S. Pat. No. 4,216,959 discloses a weight lifters safety chain.

SUMMARY OF THE INVENTION

Accordingly, it is an object of the present invention to obviate the disadvantages of the prior art by providing a device for performing exercises that is readily assembled and includes novel safety features.

It is another object of the invention to provide an apparatus that can be used for as many as 20 different exercises.

Another object of the present invention is to provide a bench type exercise device which can be readily adjusted into several different starting positions to permit the performance of a wide variety of body exercises in a sitting position, a prone position and a reclined position.

DESCRIPTION OF THE INVENTION

Figure 1:
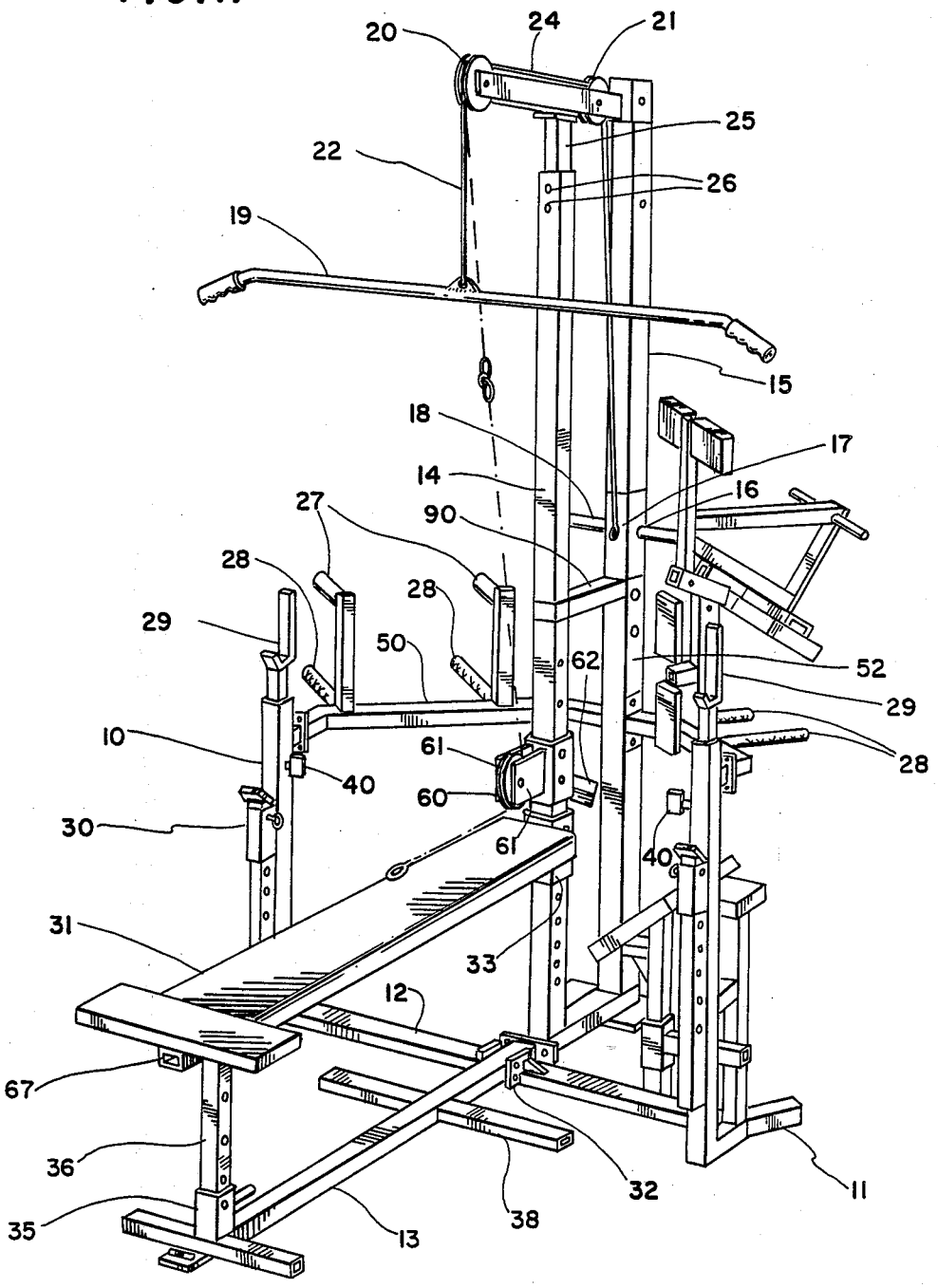
FIG. 1 is a front perspective view of the apparatus.

Referring now to FIG. 1. The exercise apparatus of the present invention is shown generally at 10 and includes a bench 11, a beam 12, a floor frame alternatively an elongated horizontal longer piece 13 and a vertical support member alternatively a second upright 14. A guide post alternatively a first upright for the weight holder carriage is designated 15 said first upright and second upright having a brace means 90 therebetween with a sliding weight plate carriage assembly shown at

16. A cable connector tab 17 connects the cable 22 to the lat bar 19. Weight holder pegs 18 protrude from the sliding weight plate carriage assembly 16. Cable pulley 20 and 21 mounted in the pulley assembly 24 to provide ease of movement of the cable between the cable connection 17 and the lat bar 19.

The vertically extending member 14 acts as a support prop for the pulley assembly 24. The height of the pulley assembly 24 can be adjusted by the pulley assembly height adjuster 25. The bolts 26 hold the element 25 in the proper position.

The device also includes a pair of dip handles 27 attached to the front of plate storage beam 50. Weight plate storage pegs 28 are also an integral part of the plate storage beam 50. Elements 29 are for bell holding risers.

The apparatus also provides an emergency racking system or adjustable bar bell holder 30. The bench board member 31 is upholstered to provide greater comfort to the user. The element 32 provides greater stability to the apparatus. An adjustable sleeve 33 provides for movement of the bench board 31 and leg board 34 on the vertical support 14.

The bench beam 67 can be adjusted vertically by means of the elevation assembly alternatively a third upright 35 and 36. The apparatus provides a foot elevator platform alternatively an elongated horizontal shorter piece 38 for use in exercising in the standing and seated position. Two sets of set screw tighteners 40 hold the plate storage beam assembly 50 in the desired position. The device also includes an adjustable main frame column and lat carriage stop 52.

A multi-purpose variable height auxilary cable pulley assembly is shown at 60 and consists of pulley connector plates 61 and foot prop 62.

Figure 2:
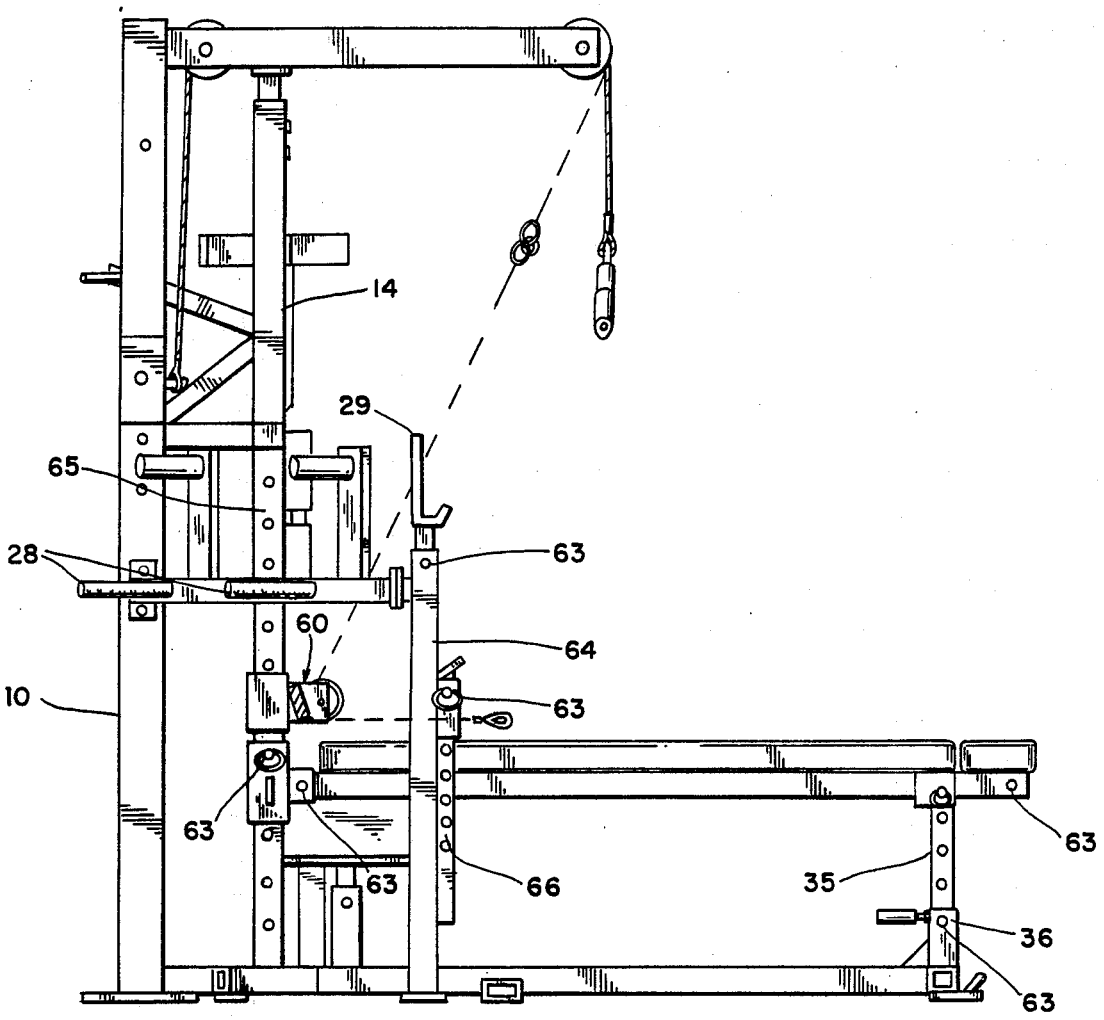
FIG. 2 is a side view of the apparatus.

Referring now to FIG. 2 which is a side view of the apparatus showing the backing system of the apparatus in detail. Self-locking pins 63 are used to lock the element 29 in place in the stationery member 64. These pins 63 also control the position of the auxillary cable assembly 60. A cable 65 connects the auxillary cable assembly 60 with the cable pulley 20. Another feature of the apparatus is the removability of the plate storage pegs 28. The forward end of each peg 28 is threaded for ready attachment and removal from the storage beam assembly 50. The self-locking pins alternatively a removable bracket 63 also control the adjustability of elevation columns 35 and 65, and the emergency racking system 66.

Figure 3:
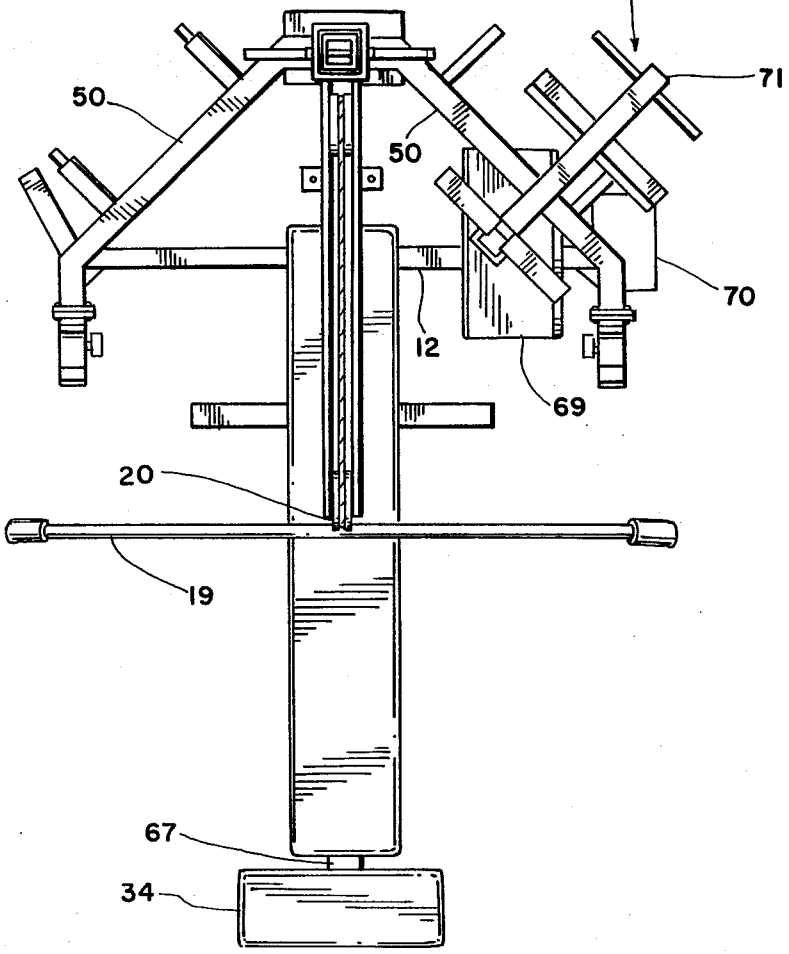
FIG. 3 is a top view of the apparatus.

Referring now to FIG. 3, which is a top view of the apparatus showing details of the leg board 34 which is attached to the main bench beam 67. The accessory storage area 68 includes the preacher's bench 69 which is attached to beam 12 by means of a holder (not shown). The incline seat attachment 70 is also attached to the beam 12 by means of a holder (not shown). The leg exercise attachment 71 is attached to the storage beam assembly 50 by means of a holder (not shown).

Figure 4:
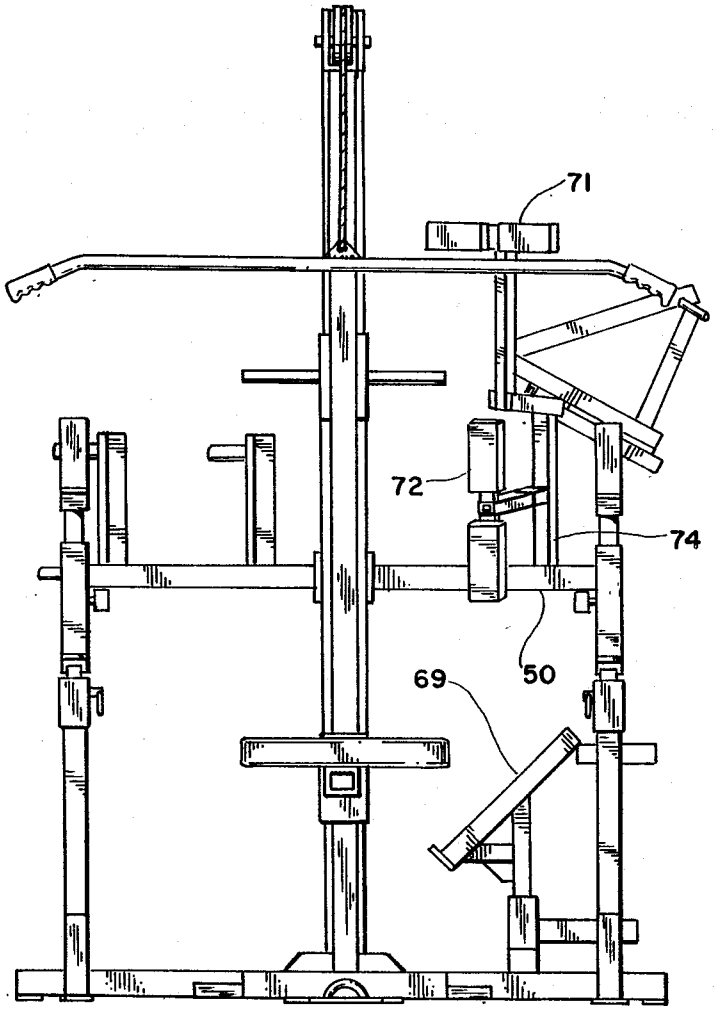
FIG. 4 is a front view of the apparatus.

Referring now to FIG. 4, which shows the decline pad 72 which is attached to storage beam 50 through a tubular holder 74. The leg attachment is also attached to the storage beam 50 by fitting into the tubular member 74.

Figure 5:
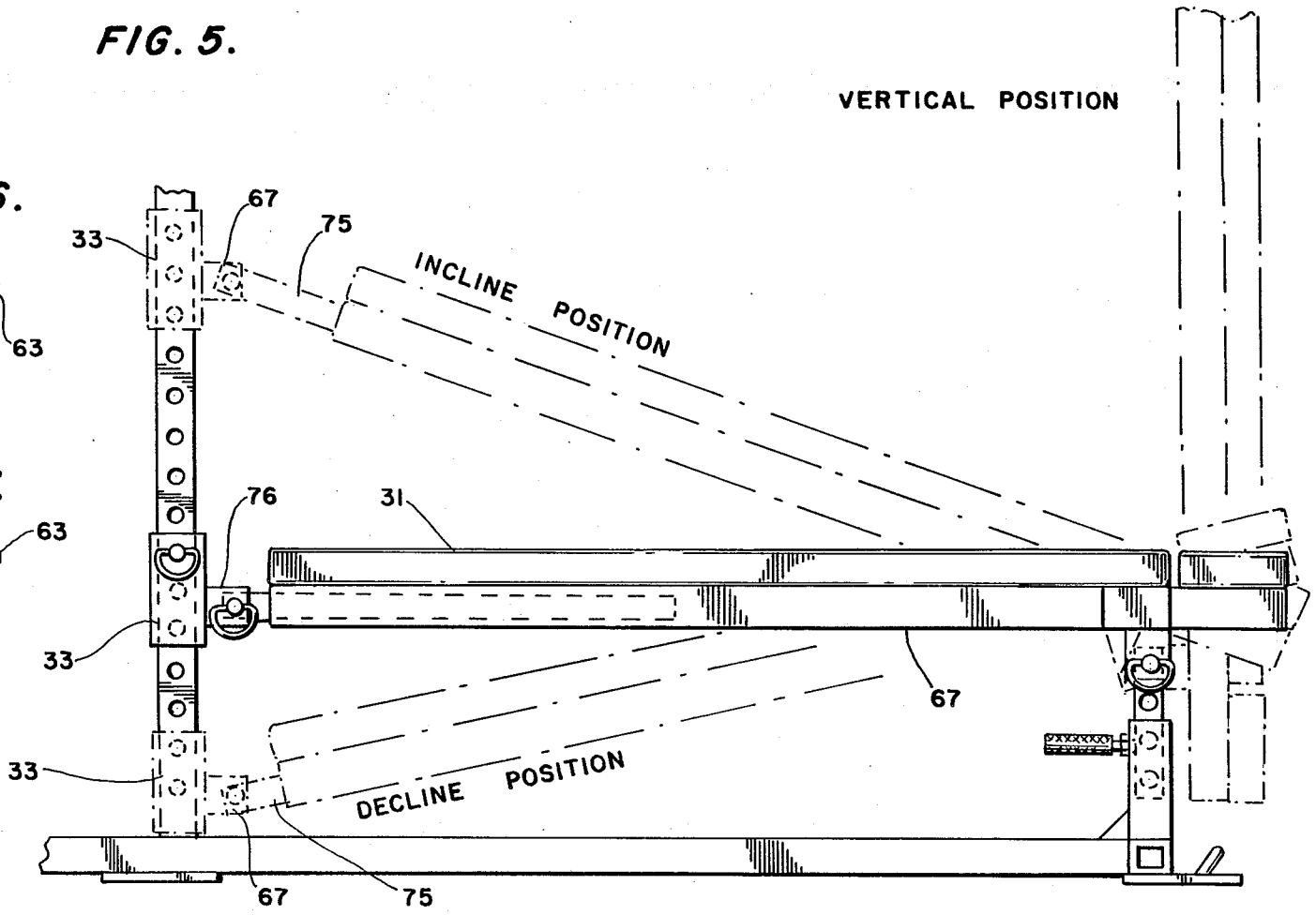
FIG. 5 is a side view showing the angular adjustability of the apparatus.

Referring now to FIG. 5 which shows the adjustability of the bench board member 31 on the main bench pad beam 67 which is tubular in configuration. The sliding adjuster member 75 is retractable or extendable in member 67. The member 75 is readily detached from member 67 for partial removal of the bench. The hinging action of member 75 is dependent on the removable hinge pin 63 and the adjustable sleeve alternatively a vertical slide means 33. This figure shows the bench board member 31 in the level position, the incline position and the decline position. The bench board member 31 can also be moved to the vertical position as is shown in this figure.

Figure 6:
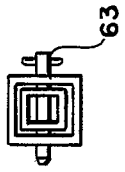
FIGS. 6 and 7 are detailed views of the locking system.
Figure 7:
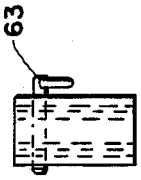

FIGS. 6 and 7 show the details of the attachment of pins 63 to the various tubular members of the apparatus. These pins are a commercially available item.

The apparatus can be used for forming a large number of individual exercises. Typical exercises include flat bench press, incline bench press and decline bench press, squats and related exercises are typical of use of the apparatus when the bench board member is in the vertical position.

Having now described the invention in detail in accordance with the requirements of the patent statutes, those skilled in the art will have no difficulty in making changes and modifications in the individual parts of their relative assembly in order to meet specific requirements or conditions. Such changes and modifications may be made without departing from the scope and spirit of the invention as set forth in the following claims.

What is claimed is:

1. An adjustable exercise device comprising a horizontal stand adapted and constructed to abut on a floor, said stand having an elongated horizontal longer piece and an elongated horizontal shorter piece at right angles to each other and together having a cruciform configuration, said longer piece having a first upright extending upwardly from one end of said longer piece, a second upright extending upwardly from said longer piece parallel and displaced from said first upright, said first upright and second upright having a brace means therebetween, a third upright extending upwardly from the other end of said longer piece, said third upright being adjustable in height and terminating in a removable bracket, an adjustable bench means positioned between said second upright and said third upright, and further extending over said bracket and hingedly attached thereto, said second upright being fitted with a vertical slide means, said second upright having a plurality of equi-spaced apertures, said apertures extending above and below the terminating end of said third upright, said vertical slide means having pin means adapted and constructed to releasably engage a selected aperture to thereby select a desired vertical position for said vertical slide means, said bench having an elongated tubular member mounted therinunder, an elongated member having a free end adapted and constructed to slide telescopingly into said elongated tubular member, said elongated member having its outer end releasibly and hingedly attached to said slide whereby said bench means may be positioned in the horizontal position, the incline position or the decline position and may be disengaged from the second upright and raised to a vertical position all as desired.

* * * * *